US011259564B2

(12) United States Patent
Bodenchuk et al.

(10) Patent No.: US 11,259,564 B2
(45) Date of Patent: Mar. 1, 2022

(54) PIPE LIGHTER HOLDER AND TOOL

(71) Applicant: Lifted Limited, LLC, Grand Junction, CO (US)

(72) Inventors: Matthew Robert Bodenchuk, Grand Junction, CO (US); Leslie Renea Bodenchuk, Grand Junction, CO (US)

(73) Assignee: Lifted Limited, LLC, Breckenridge, CO (US)

( * ) Notice: Subject to any disclaimer, the term of this patent is extended or adjusted under 35 U.S.C. 154(b) by 0 days.

(21) Appl. No.: 16/514,601

(22) Filed: Jul. 17, 2019

(65) Prior Publication Data

US 2019/0335806 A1 Nov. 7, 2019

Related U.S. Application Data

(63) Continuation-in-part of application No. 16/237,232, filed on Dec. 31, 2018, now Pat. No. 10,694,779, which is a continuation of application No. 15/921,059, filed on Mar. 14, 2018, now Pat. No. 10,201,183, which is a continuation of application No. 13/760,442, filed on Feb. 6, 2013, now Pat. No. 9,930,912.

(60) Provisional application No. 61/595,532, filed on Feb. 6, 2012.

(51) Int. Cl.
*A24F 9/02* (2006.01)

(52) U.S. Cl.
CPC ..... *A24F 9/02* (2013.01)

(58) Field of Classification Search
CPC ..... A24F 27/06
See application file for complete search history.

(56) References Cited

U.S. PATENT DOCUMENTS

| | | | | |
|---|---|---|---|---|
| 544,691 | A * | 8/1895 | Rupprecht | |
| 1,720,460 | A * | 7/1929 | Ament | A24F 27/06 431/356 |
| 1,782,026 | A | 11/1930 | Beyer | |
| 1,845,340 | A | 2/1932 | Ritz | |
| 2,005,557 | A | 6/1935 | Penney | |
| 2,043,888 | A | 6/1936 | Denit | |
| 2,294,133 | A | 8/1942 | Leon | |
| 2,460,427 | A | 2/1949 | Musselman et al. | |

(Continued)

FOREIGN PATENT DOCUMENTS

| | | | |
|---|---|---|---|
| GB | 209416 | A | 7/1924 |
| GB | 575451 | A | 2/1946 |

OTHER PUBLICATIONS

U.S. Appl. No. 16/237,232, Final Office Action dated Apr. 22, 2020, all pages.

(Continued)

*Primary Examiner* — Eric Yaary
(74) *Attorney, Agent, or Firm* — Kilpatrick Townsend & Stockton, LLP

(57) ABSTRACT

A standard smoking lighter slides into a hole on top of a plastic sheath so that only the top of the lighter is exposed. The bottom of the sheath has a hammer like protrusion at one end to stuff tobacco or other herb into a pipe. The opposite end of the bottom has a pivot point for a poker which serves to mix the herb and ash within the pipe and/or clean the debris from the pipe. The poker folds up into the sheath when not in use. Thus, a three function pipe tool provides a lighter, a stuffer and a poker.

21 Claims, 13 Drawing Sheets

(56) References Cited

U.S. PATENT DOCUMENTS

| | | | | |
|---|---|---|---|---|
| 2,777,569 | A | 1/1957 | Starke, Jr. | |
| 2,856,098 | A | 10/1958 | Heinrich | |
| 2,982,454 | A * | 5/1961 | Wolberg | A24F 47/00 224/241 |
| 3,200,822 | A | 8/1965 | Meyer | |
| 3,263,690 | A | 8/1966 | Buckley | |
| 3,356,208 | A * | 12/1967 | Kondo | |
| 3,923,085 | A | 12/1975 | Nimer | |
| 4,043,348 | A | 8/1977 | Kanady | |
| 4,152,109 | A | 5/1979 | Schaffer | |
| 4,230,224 | A | 10/1980 | Weeks | |
| 4,233,998 | A * | 11/1980 | Radey, Jr. | |
| 4,318,416 | A | 3/1982 | Thornhill | |
| 4,342,902 | A | 8/1982 | Ping | |
| 4,538,751 | A * | 9/1985 | Peterson | |
| 4,600,022 | A | 7/1986 | Pierce, Jr. | |
| 6,693,850 | B2 | 2/2004 | Mulaw | |
| D548,883 | S | 8/2007 | Lin | |
| D586,953 | S * | 2/2009 | Riggio | D27/125 |
| D662,655 | S | 6/2012 | Bodenchuk et al. | |
| D739,600 | S | 9/2015 | Paramadilok | |
| D749,262 | S | 2/2016 | Schoenfeld | |
| D751,250 | S | 3/2016 | Vuong | |
| D806,946 | S | 1/2018 | Deahj | |
| 9,930,912 | B2 | 4/2018 | Bodenchuk et al. | |
| 10,201,183 | B2 | 2/2019 | Bodenchuk et al. | |
| 2004/0219468 | A1 * | 11/2004 | Hanosek | |
| 2007/0000502 | A1 * | 1/2007 | Chong | A24F 13/24 131/249 |
| 2008/0142026 | A1 * | 6/2008 | Chou | A24F 9/04 131/243 |
| 2010/0065073 | A1 | 3/2010 | Sweeney | |
| 2010/0101591 | A1 | 4/2010 | Rosso | |
| 2010/0263172 | A1 * | 10/2010 | Wein | F23Q 2/34 24/303 |
| 2013/0199548 | A1 * | 8/2013 | Bodenchuk | A24F 9/02 131/247 |
| 2014/0011144 | A1 | 1/2014 | Hancock et al. | |
| 2016/0183591 | A1 | 6/2016 | Thorne et al. | |
| 2017/0086496 | A1 * | 3/2017 | Cameron | B26B 11/001 |
| 2017/0241642 | A1 * | 8/2017 | Kaplan | F23Q 2/50 |
| 2018/0360108 | A1 * | 12/2018 | King, Jr. | A24F 3/00 |
| 2019/0239560 | A1 * | 8/2019 | Flynn | A24F 13/18 |
| 2019/0297942 | A1 * | 10/2019 | Kang | A24F 13/24 |

OTHER PUBLICATIONS

U.S. Appl. No. 16/237,232, Notice of Allowance dated May 13, 2020, all pages.

Final Office action dated Sep. 9, 2016 in U.S. Appl. No. 13/760,442, 8 pages.

Non-Final Office action dated Jun. 6, 2017 in U.S. Appl. No. 13/760,442, 7 pages.

Toker Pokers by Toker Poker dated 2018. Found on Line [Jan. 14, 2019], https://tokerpoker.com/collections/toker-pokers, entire site.

Notice of Allowance dated Jan. 30, 2019 in U.S. Appl. No. 29/630,603, all pages.

Non-Final Office action dated Jul. 30, 2019 in U.S. Appl. No. 16/237,232, all pages.

* cited by examiner

PIPE LIGHTER HOLDER AND TOOL

CROSS-REFERENCE TO RELATED APPLICATIONS

The present application is a continuation-in-part of U.S. patent application Ser. No. 16/237,232 filed Dec. 31, 2018, which is a continuation of U.S. patent application Ser. No. 15/921,059 filed Mar. 14, 2018, and issued as U.S. Pat. No. 10,201,183, which is a continuation of U.S. patent application Ser. No. 13/760,442 filed Feb. 6, 2013, and issued as U.S. Pat. No. 9,930,912, which claims priority to U.S. Provisional Application No. 61/595,532 filed Feb. 6, 2012, the disclosures of which are incorporated herein by reference.

FIELD OF INVENTION

The present invention relates to a combination pipe/cigarette lighter holder, a pipe poker, used to clean the herb from the pipe and/or mix the herb and ash in the pipe, and a tobacco or an herb stuffer.

BACKGROUND OF THE INVENTION

Combination cigarette lighter holders and cigarette cases are well known in the art. Also known are lighter holders with pockets. Also known is a pipe lighter holder that actually forms a miniature pipe. The traditional pipe smoker must use a lighter as well as a tobacco stuffer and a pipe poker to enjoy his pipe.

SUMMARY OF THE INVENTION

The main aspect of the present invention is to provide a pocket sized sheath for a standard cigarette or smoking lighter, wherein the base of the sheath has a hammer like end and a folding poker end. The present invention provides a plastic case to hold a standard lighter. The case has a hammer shaped base on one side to serve as a tobacco or an herb stuffer. The other side of the base has a hinged poker to provide a metal rod to mix the tobacco or other herb and/or clean the pipe. When not in use the poker folds into the case.

In one aspect, a smoker's pipe tool is provided. The pipe tool may include a sheath having a top, a bottom, and at least one sidewall extending between the top and the bottom along a longitudinal axis of the sheath. The sheath may define a central recess that extends along at least a portion the longitudinal axis and that is configured to slidingly receive a lighter. The sheath may also define an additional recess that extends alongside at least a portion of the central recess. The pipe tool may also include an elongated poker that is removably coupled with the sheath. The elongated poker may have a first end and a second end. The first end may be thicker than the second end and may be configured to function as a pipe bowl tamper. The additional recess may be configured to retain the elongated poker when the elongated poker is slidingly received within the additional recess.

In another aspect, a smoker's pipe tool includes a sheath having a top, a bottom, and at least one sidewall extending between the top and the bottom along a longitudinal axis of the sheath. The sheath may define a central recess that extends along the longitudinal axis and that may be configured to slidingly receiving a lighter. The sheath may define a slot or an additional recess that extends along at least a portion of the length of the sheath and the sheath may also define a closeable compartment that is spaced apart from the central recess and the slot or the additional recess. The pipe tool may also include an elongated poker that is coupled with the sheath and is movable between a stowed position and an open position. When the elongated poker is in the stowed position, at least a portion of the elongated poker may be disposed within the slot or the additional recess. When the elongated poker is in the open position at least a portion of the elongated poker may be at least partially disengageable from the slot or the additional recess such that a tip of the elongated poker is insertable into a pipe bowl. One or both of the sheath or the elongated poker may include a pipe bowl tamper portion.

In another aspect, a smoker's pipe tool may include a sheath having a top, a bottom, and at least one sidewall extending between the top and the bottom along a longitudinal axis of the sheath. The sheath may define a central recess that extends along the longitudinal axis and that may be configured to slidingly receiving a lighter. The sheath may define a slot or an additional recess that extends along at least a portion of the length of the sheath. The pipe tool may also include a carb cap that may be configured to cover an opening of a pipe and an elongated poker that may be coupled with the sheath and may be movable between a stowed position and an open position. When the elongated poker is in the stowed position, at least a portion of the elongated poker may be disposed within the slot or the additional recess. When the elongated poker is in the open position at least a portion of the elongated poker may be at least partially disengageable from the slot or the additional recess such that a tip of the elongated poker is insertable into a pipe bowl. One or both of the sheath or the elongated poker may include a pipe bowl tamper portion.

Other aspects of this invention will appear from the following description and appended claims, reference being made to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
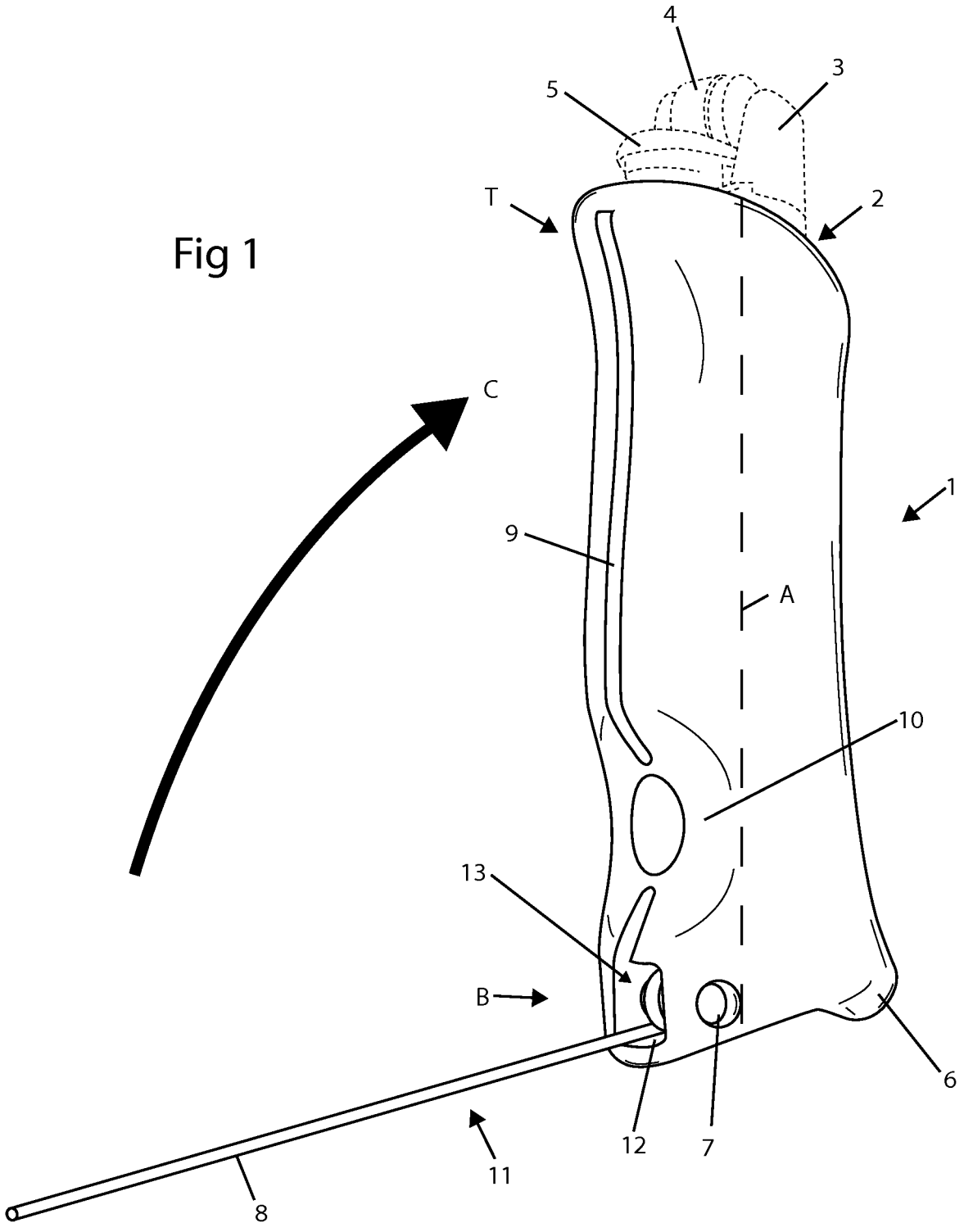
FIG. 1 is a top perspective view of a lighter holder and tool showing a poker extended therefrom according to embodiments of the invention.

Referring first to FIG. 1 a pipe tool 1 is preferably made from a plastic mold, but may also be made from a variety of materials such as silicon, metal, wood, stone, etc., and/or combinations thereof. A central recess 2 at the top section T is sized to hold a standard smoking lighter 4 such as a BIC® classic lighter, BIC® mini lighter, and/or any other disposable and/or reusable lighter. The lighter 3 has a thumb actuator 4 and gas release button 5, all standard in the art.

The bottom section B has a protrusion 6 which faces down and out from a central axis A of the pipe tool 1. Opposite the protrusion 6 is a pivot point 7 which secures the base of a foldable poker 8. The poker 8 is preferably a metal rod. Poker 8 folds in direction C into slot 9 in the passive mode. To move the poker 8 to the active mode shown, a recess 10 is provided to allow the user to pry up on section 11 of the poker 8. A ledge 12 at the base section B stops the poker 8 at about a 90° angle to axis A. A hole 13 allows the poker 8 to pivot around pivot point 7.

Figure 2:
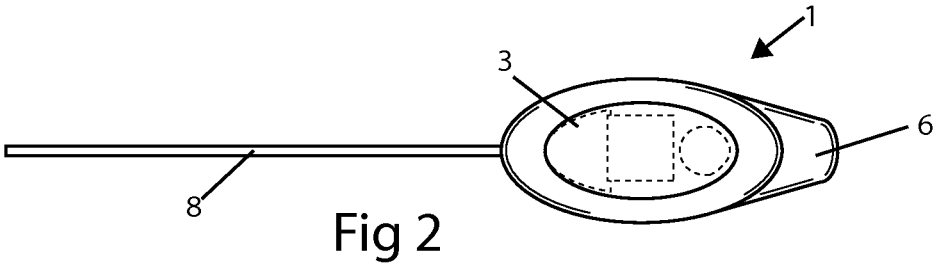
FIG. 2 is a is a top plan view thereof.
Figure 3:
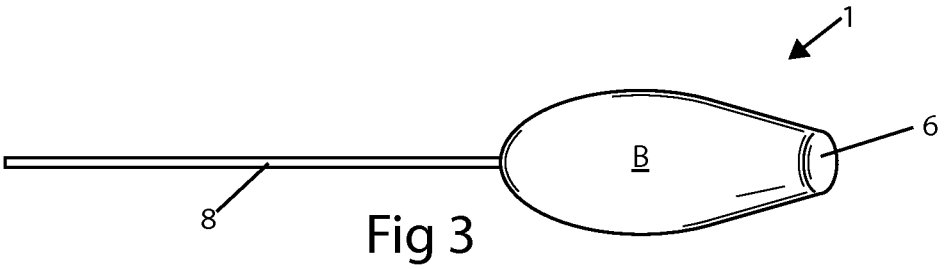
FIG. 3 is bottom plan view thereof.
Figure 4:
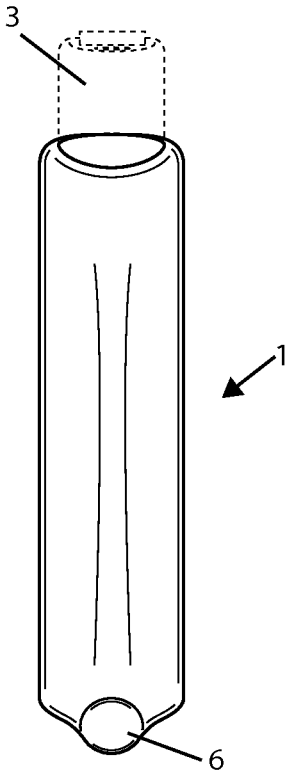
FIG. 4 is a rear elevation view thereof.
Figure 5:
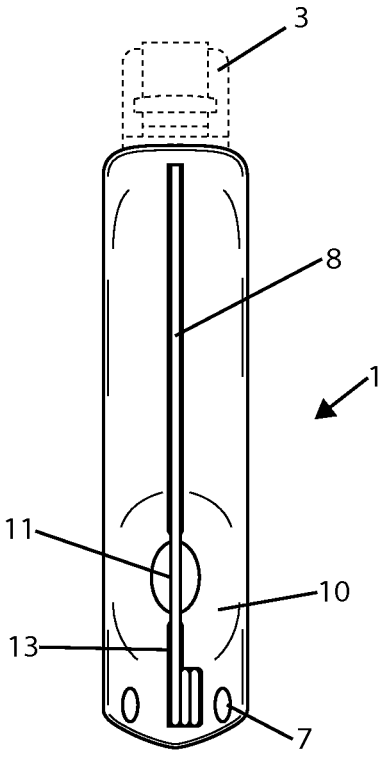
FIG. 5 is front elevation view thereof.

Referring next to FIGS. 2 and 3 the top and bottom views in the active mode are shown. FIG. 4 shows the protrusion 6 which is used as an herb or tobacco stuffer when loading and/or smoking a pipe. FIG. 5 shows the passive mode in a front elevation view.

Figure 6:
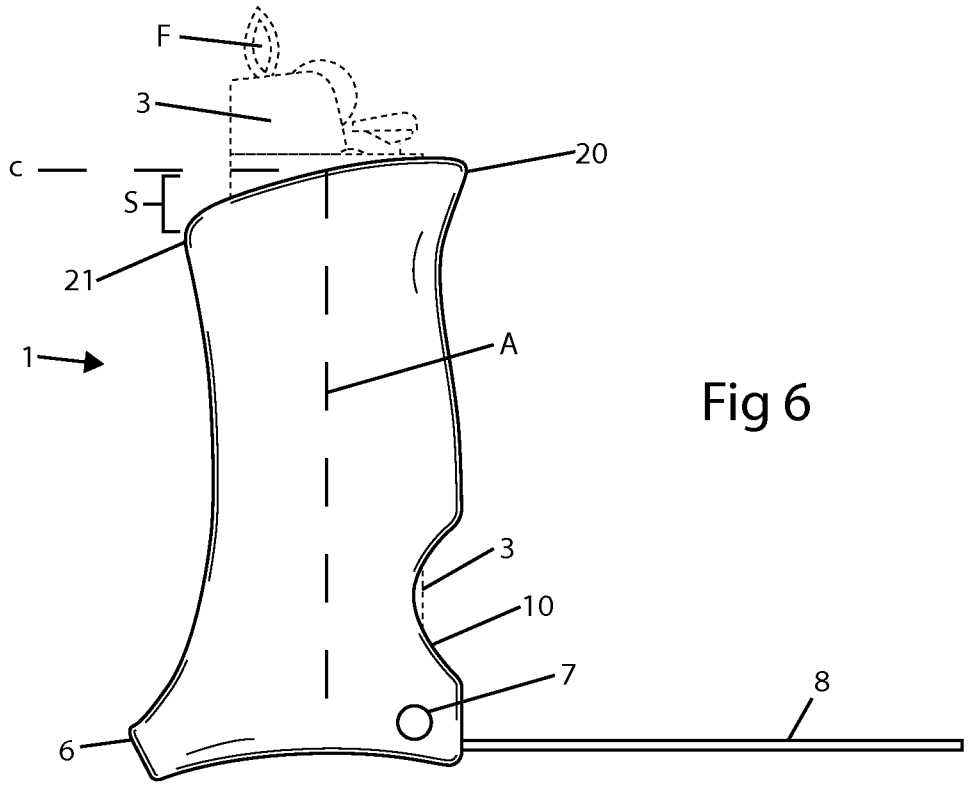
FIG. 6 is right side elevation view thereof.
Figure 7:
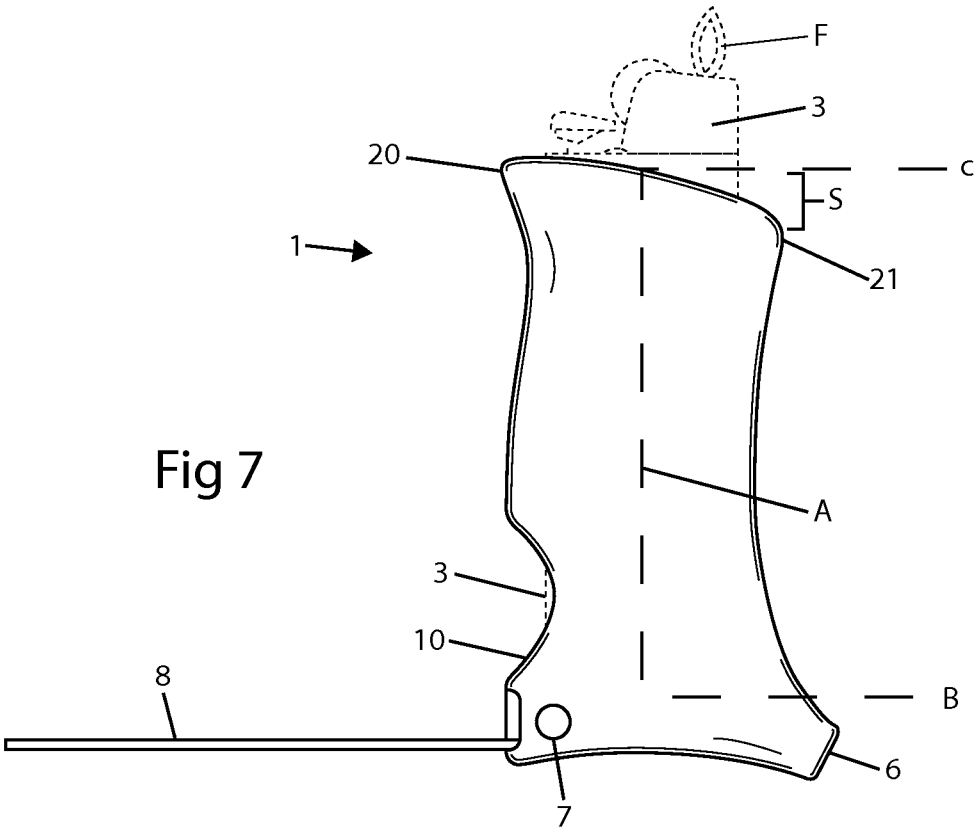
FIG. 7 is a left side elevation view thereof.

In FIGS. 6 and 7 the active mode of pipe tool 1 is shown. A horizontal line C is drawn at a 90° angle to axis A from the very top 20 of pipe tool 1. A space S is formed between the line C and the lower top segment 21. This body shape increases the distance from the flame F to the top segment 21 which allows a wide range of tilt angles for the pipe tool to be used without burning the pipe tool 1.

Figure 8:
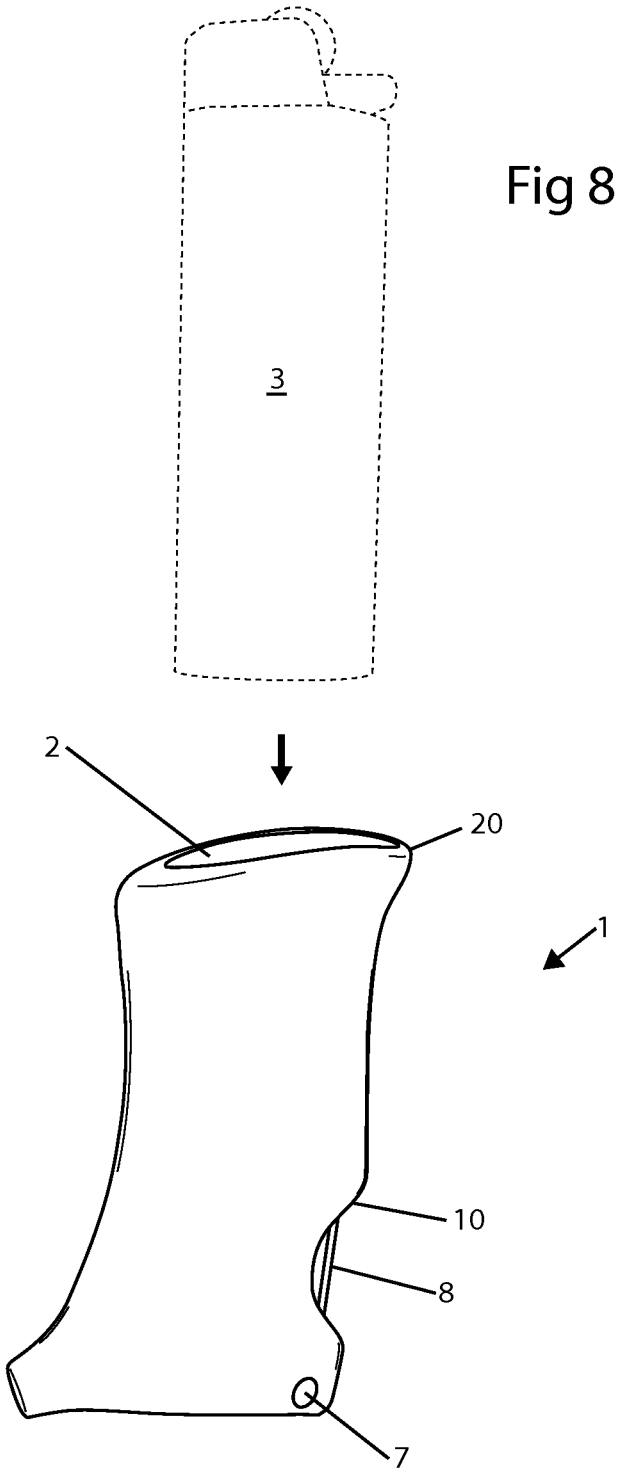
FIG. 8 is an exploded view of the invention.
Figure 9:
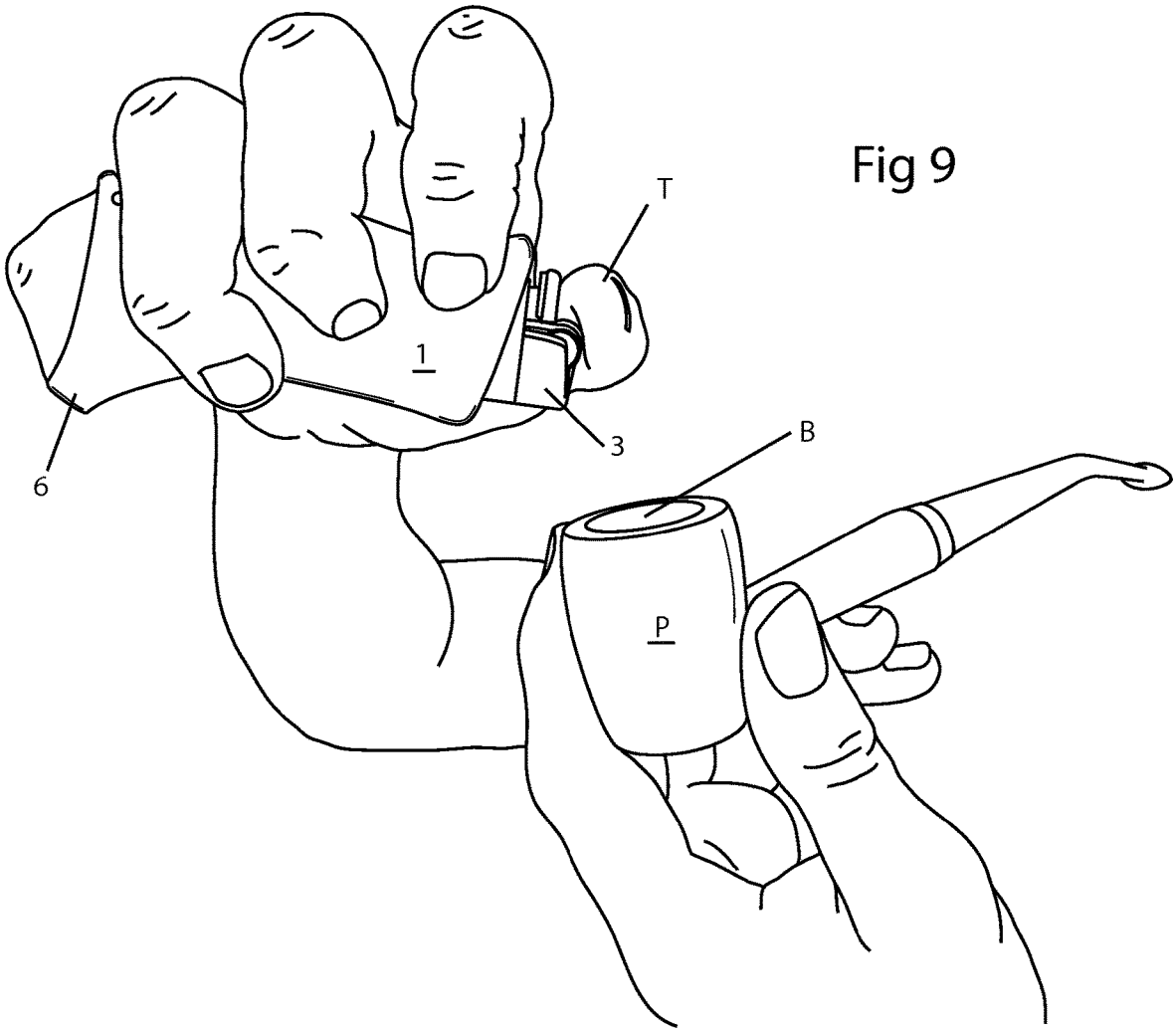
FIG. 9 is a front perspective view of the invention used as a lighter.

In FIG. 8 the central recess 2 is shown to be sized to firmly secure the lighter 3. In FIG. 9 the user's thumb T is about to light the tobacco or other herb (not shown) in the bowl B of pipe P.

Figure 10:
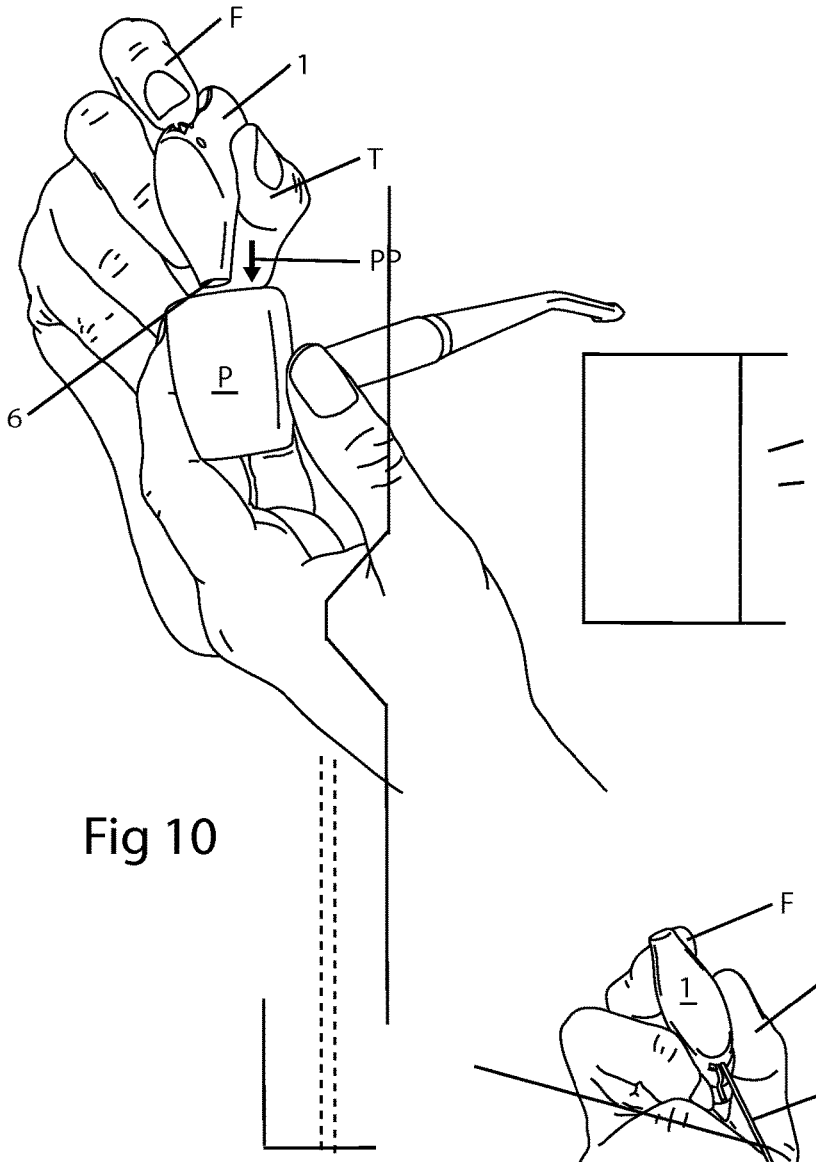
FIG. 10 is a side perspective view of the invention used as a stuffer.

In FIG. 10 the user's thumb T and index finger Fuse the end 6 to stuff down the tobacco or other herb (not shown) in direction PP.

Figure 11:
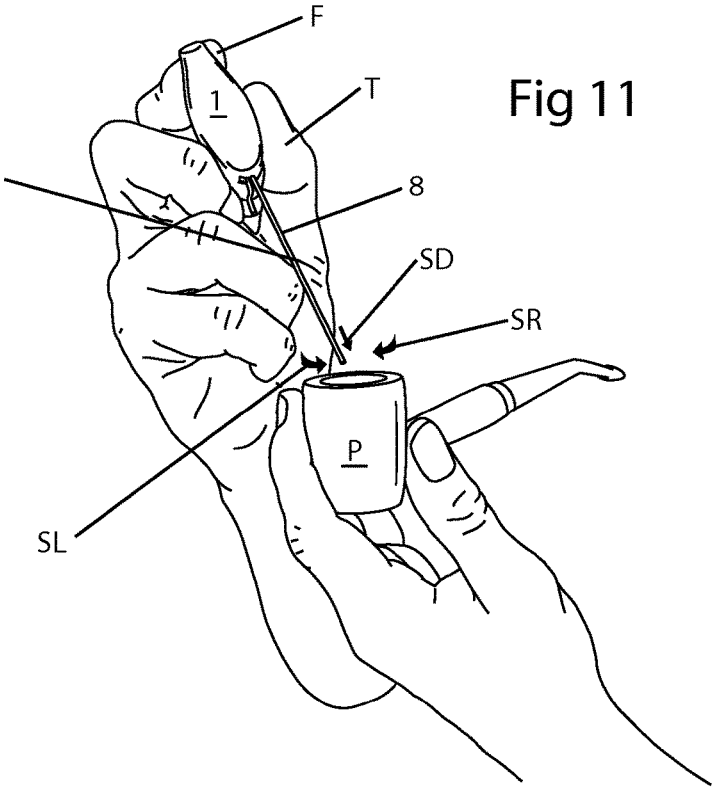
FIG. 11 is a front perspective view of the invention used as a poker.

In FIG. 11 the user's fingers, the thumb T and index finger F, support the pipe tool 1 so as to move the poker 8 in directions down SD, left SL and right SR. The poker 8 is in the active mode position.

Figure 12:
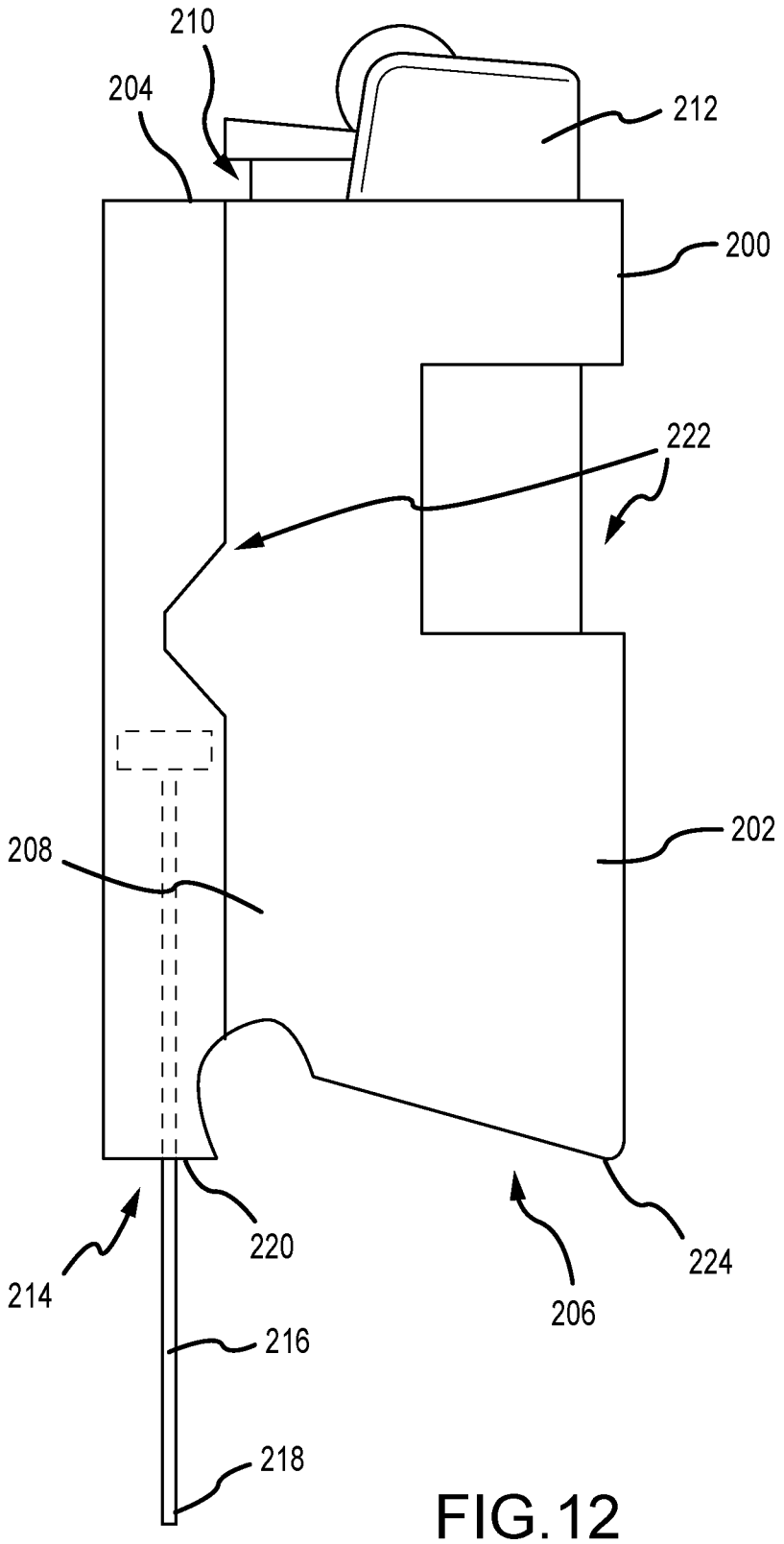
FIG. 12 is a left side elevation view of a lighter holder and a poker according to embodiments of the invention.

FIG. 12 illustrates another embodiment of a pipe tool 200. Pipe tool 200 may be similar to pipe tool 1. For example, pipe tool 200 may be formed from plastic, wood, and/or other natural and/or synthetic material and may include a sheath 202 having a top 204 and a bottom 206. At least one sidewall 208 may be disposed between the top 204 and the bottom 206 of the sheath 202, extending along a longitudinal axis of the sheath 202. The sheath 202 may define a central recess 210 that extends into a body of the sheath 202 from the top 204 of the sheath 202 and extends along at least a portion of the longitudinal axis. The central recess 210 may be sized and shaped to hold a standard smoking lighter 212, such as a BIC® lighter. For example, the lighter 212 may be slidingly received within the central recess 210 and retained using a friction fit, snap-fit, latch, and/or other releasable securement mechanism.

Rather than (or in addition to) having a slot similar to pipe tool 1, the sheath 202 may also define an additional recess 214 that extends alongside (and spaced apart from) at least a portion of the central recess 210. While shown with additional recess 214 extending along all or a substantial portion of the length of the sheath 202, it will be appreciated that in some embodiments the additional recess 214 may extend along a small portion of the length, such as between about 25% and 75% of the length, or any other portion of the length. The additional recess 214 may be sized and shaped to receive and retain all or a portion of an elongated poker 216, such as by the elongated poker 216 being slid into and out of the additional recess 214. For example, the additional recess 214 may be configured to retain the elongated poker 216 using a friction fit, snap fit, and/or other securement mechanism. In some embodiments, a magnetic element (not shown) may be provided within the additional recess 214 that attracts a metal portion of the elongated poker 216 and retains the elongated poker 216 within the additional recess 214 until withdrawn by a user. In some embodiments, one end of the additional recess 214 may be fully or partially closed such that the material that at least partially closes the end serves as a stop for the elongated poker 216 when inserted within the additional recess 214.

As illustrated, elongated poker 216 includes a first end 218 and a second end 220, with the second end 220 being thicker than the first end 218. This allows the second end 220 to be utilized as a pipe bowl tamper, while the first end 218 may be used as a poker to mix tobacco or other herb and/or to clean a pipe. In some embodiments, the elongated poker 216 may gradually taper (with a constant and/or variable degree of taper) from the first end 218 to the second end 220. In some embodiments, such as illustrated in FIG. 12, the elongated poker 216 may include a step that provides an abrupt transition between thicknesses of the first end 218 and the second end 220. In some embodiments, rather than having the pipe bowl tamper being formed from the second end 220, the tamper may be formed from a protrusion extending from the sheath 202, similar to protrusion 6 described above. In such embodiments, the elongated poker 216 may or may not be fully removable from the additional recess 214. For example, in some embodiments the elongated poker 216 may be slidable such that a portion of the elongated poker 216 extends from a body of the sheath 202 while a remaining portion of the elongated poker 216 is retained within the additional recess 214. For example, the larger second end 220 may contact a narrower portion of the additional recess to stop the elongated poker 216 from sliding fully out of engagement with the additional recess 214.

In some embodiments, the sheath 204 may define one or more cutout portions 222 that extend through the sidewall(s) 208 and provide access to a medial portion of an interior of the central recess 210 and/or the additional recess 214. These cutout portions 22 may allow a user to push on a medial portion of the lighter 212 and/or the elongated poker 216 to help the user more easily remove the component from the sheath 202.

In some embodiments, the bottom 206 of the sheath 202 includes a bottle opener 224. Bottle opener 224 may be formed integrally with the sheath 202 or may be a separate component that is affixed to the bottom 206 (or other portion) of the sheath 202. When the bottle opener 224 is a separate component, the bottle opener 224 may be formed from a different material than the sheath 202. For example, if the sheath 202 is made from a plastic material, the bottle opener 224 may be formed from metal or similar material to provide greater durability.

Figure 13:
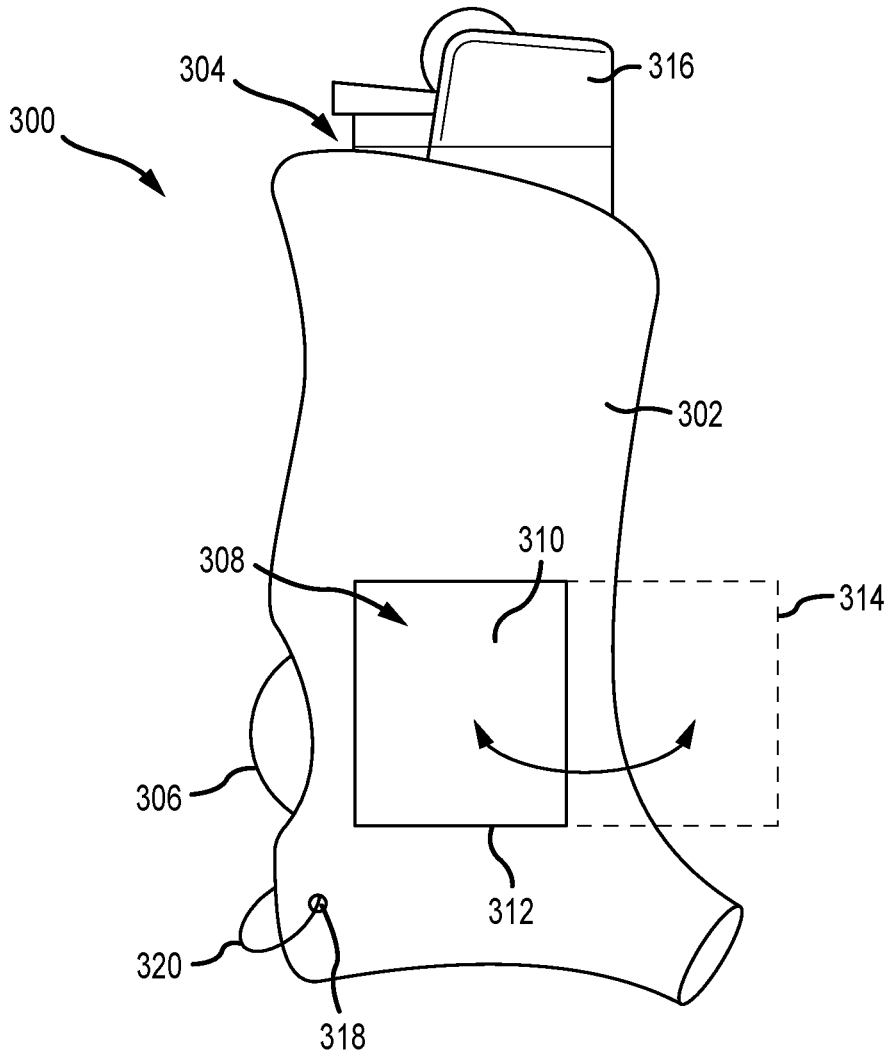
FIG. 13 is a left side elevation view of a lighter holder having a closeable storage compartment according to embodiments of the invention.

FIG. 13 depicts another embodiment of a pipe tool 300. Pipe tool 300 may be similar to and may include any of the features described in association with pipe tool 1 and/or pipe tool 200 described above. For example, the pipe tool 300 may include a sheath 302 that includes a central recess 304 for receiving a lighter 316. The sheath 302 may define a slot (similar to slot 9) and/or an additional recess (similar to additional recess 214) that extends along at least a portion of the length of the sheath 302 and that is spaced apart from the central recess 304. The slot and/or additional recess may be configured to receive and retain at least a portion of an elongated poker 306, which may be similar to poker 8 and/or elongate poker 216 described above. The elongated poker 306 may be movable between a stowed position and an open position. In the stowed position, at least a portion of the elongated poker is disposed within the slot or the additional recess. For example, the stowed position may involve the elongated poker 306 being pivoted into the slot as described in relation to FIG. 1 or may involve the elongated poker 306 being slidingly received within the additional recess as described in relation to FIG. 12. In the open position at least a portion of the elongated poker 306 is at least partially disengageable from the slot or the additional recess such that a tip of the elongated poker 306 is insertable into a pipe bowl. For example, the open position may involve the elongated poker 306 being pivoted out of the slot such that a tip of the elongated poker 306 extends away from a body of the sheath 302 and is insertable into a pipe bowl as illustrated in relation to FIGS. 1-11. In other embodiments, the open position may involve the elongated poker 306 being partially and/or fully slid out of and/or otherwise removed from the additional recess.

The pipe tool 300 may also include a tamper portion. For example, the elongated poker 306 may include a tamper portion similar to second end 220 described in relation to FIG. 12. In other embodiments, the tamper portion may be formed into the sheath 302, similar to protrusion 6 described in relation to FIGS. 1-11.

The sheath 302 may further define at least one storage compartment 308. The compartment 308 may be used to store any number of objects, such as matches, tobacco and/or other herb, rolling papers, tools, and the like. The compartment 308 may extend partially through the sheath 302 such that the compartment 308 includes a back wall 310 and at least one side wall 312 that define a size and shape of the compartment 308. As illustrated, a hinged cover 314 is provided that is configured to be moved between an open position in which the interior of the compartment 308 is accessible and a closed position in which the cover 314 covers an opening to the compartment 308. The cover 314 may be configured to latch and/or snap into engagement with the compartment 308 and/or edges of the compartment 308 such that the cover 314 is retained in the closed position until actuated by a user. The cover 314 may include one or more protrusions, slots, and/or textured elements (not shown) that may allow a user to grasp and/or otherwise manipulate the cover 314 between the closed and open positions. In some embodiments, a sealing element, such as an O-ring, gasket, and/or other sealing mechanism may be provided on the portion of the sheath 302 defining the compartment 308 and/or the cover 314 such that the compartment 308 is sealed, in some embodiments with a water-tight seal, when the cover 314 is in the closed position.

While illustrated as a stationary compartment 308 having a hinged cover 314, it will be appreciated that in some embodiments other compartment designs are possible. For example, a slidable drawer may be configured to slide in and out of a recess formed within a body of the sheath 302. The drawer may be used to store any number of objects. In some embodiments, a sealing member may be provided at an interface of the drawer and a surface of the sheath 302 to seal the drawer. In some embodiments, the sealing member may have an x-shaped cross-section, which may help prevent the sealing member from twisting as the drawer is slid in and out.

While shown with compartment 308 being formed in a major surface of the sidewall of the sheath 302, it will be appreciated that other locations (such as on a minor surface of the sidewall and/or a bottom of the sheath 302) may be contemplated in accordance with the present invention. Moreover, in some embodiments, the compartment 308 may be defined in multiple faces of the sheath 302. Additionally, the compartment 308 may have any size and/or shape to match the needs of a particular pipe tool 300.

In some embodiments, the sheath 302 may define an aperture 318 that is configured to receive a retention ring 320, keychain, lanyard, and/or other mechanism that allows the pipe tool 300 to be secured to another object.

Figure 14:
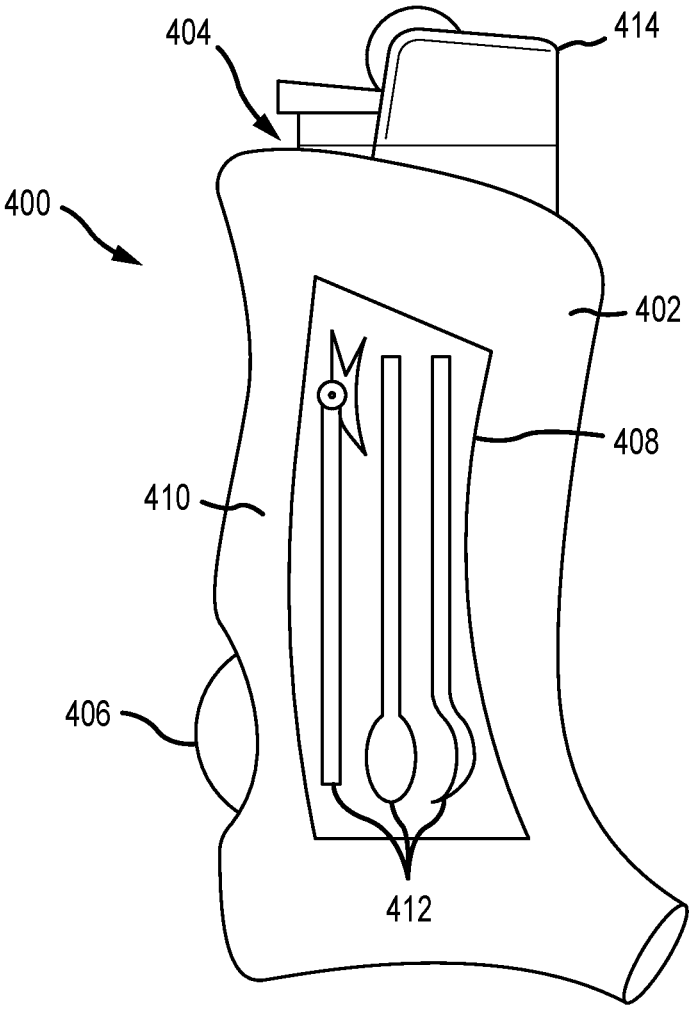
FIG. 14 is a left side elevation view of a lighter holder having removable tools according to embodiments of the invention.

FIG. 14 depicts a pipe tool 400 that may be similar to the other pipe tools described herein. For example, pipe tool 400 may include a sheath 402 that includes a central recess 404 for receiving a lighter 414. The sheath 402 may define a slot (similar to slot 9) and/or an additional recess (similar to additional recess 214) that extends along at least a portion of the length of the sheath 402 and that is spaced apart from the central recess 404. The slot and/or additional recess may be configured to receive and retain at least a portion of an elongated poker 406, which may be similar to poker 8 and/or elongate poker 216 described above. The pipe tool 400 may also include a tamper portion. For example, the elongated poker 406 may include a tamper portion similar to second end 220 described in relation to FIG. 12. In other embodiments, the tamper portion may be formed into the sheath 402, similar to protrusion 6 described in relation to FIGS. 1-11.

In some embodiments, the sheath 402 may include a magnet 408 that is affixed to at least one sidewall of the sheath 402. As illustrated here, the magnet 408 is secured to a major sidewall 410 (with major sidewalls having larger surface areas than minor sidewalls) of the sheath 402, although other locations are possible. The magnet 408 may be secured to the sheath 402 using an adhesive and/or mechanical connection. A number of tools 412 may be provided that are formed of ferromagnetic materials that may be secured to a side of the sheath 402 by the magnet 408. For example, the tools 412 may include a knife, a dabber, a poker, tweezers, a clip, scissors, a corkscrew and/or other small tools that may be secured to the sheath 402, typically with minimal protrusion from a side of the sheath 402. In some embodiments, the magnet 408 may be formed or otherwise embedded within a body of the sheath 402 such that all or a substantial portion of the surface of the magnet 408 is not exposed, thereby providing a more uniform, finished appearance while still allowing various tools to be magnetically attached to the sheath 402. Additionally, in some embodiments the magnet 408 may have sufficient magnetic force to allow the pipe tool 400 (including any attached tools, accessories other stored items, and/or lighter) to be magnetically secured to a ferromagnetic structure, such as a refrigerator and/or ferromagnetic beam, plate, etc.

Figure 15:
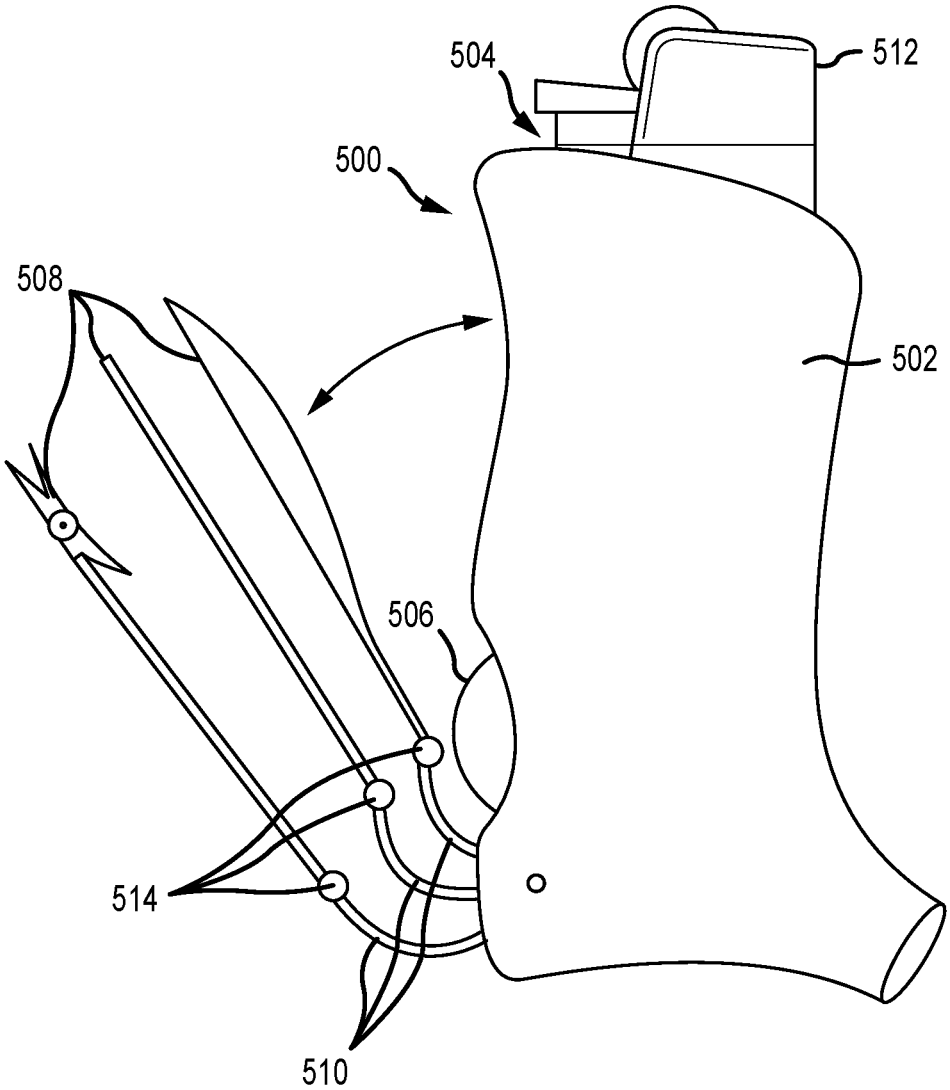
FIG. 15 is a left side elevation view of a lighter holder having replaceable tools according to embodiments of the invention.

FIG. 15 depicts a pipe tool 500 that may be similar to the other pipe tools described herein. For example, pipe tool 500 may include a sheath 502 that includes a central recess 504 for receiving a lighter 512. The sheath 502 may define a slot (similar to slot 9) and/or an additional recess (similar to additional recess 214) that extends along at least a portion of the length of the sheath 502 and that is spaced apart from the central recess 504. The slot and/or additional recess may be configured to receive and retain at least a portion of an elongated poker 506, which may be similar to poker 8 and/or elongated poker 216 described above. The pipe tool 500 may also include a tamper portion. For example, the elongated poker 506 may include a tamper portion similar to first end 218 described in relation to FIG. 12. In other embodiments, the tamper portion may be formed into the sheath 502, similar to protrusion 6 described in relation to FIGS. 1-11.

Pipe tool 500 may include a number of removable and/or replaceable tools 508. Tools 508 may include a knife, a dabber, a poker (in some cases this poker may replace elongated poker 506, while in other embodiments both a fixedly coupled and a removably coupled poker may be included on a single pipe tool 500), tweezers, a clip, scissors, magnifying glass, and/or other small tools that may be secured to the sheath 502. In some embodiments, each tool 508 may be pivotable out of a slot formed in the sheath 502 using a pivotable connector 510, similar how to the pivotable poker 8 operates as described with respect to FIGS. 1-11. In some embodiments, the pivotable connectors 510 may allow the tools to be removed and/or replaced from the pipe tool 500. For example, each pivotable connector 510 may include a connection mechanism 514, such as a clasp, hook, magnet, threaded connector, and/or other mechanical connector that allows the pivotable connector 510 to be removably coupled with a corresponding connector formed on a particular tool 508. This allows the arrangement and composition of the tools 508 to be modified and also allows the tools 508 to be removed from the pipe tool 500 for easier use, cleaning, repair, etc.

Figure 16:
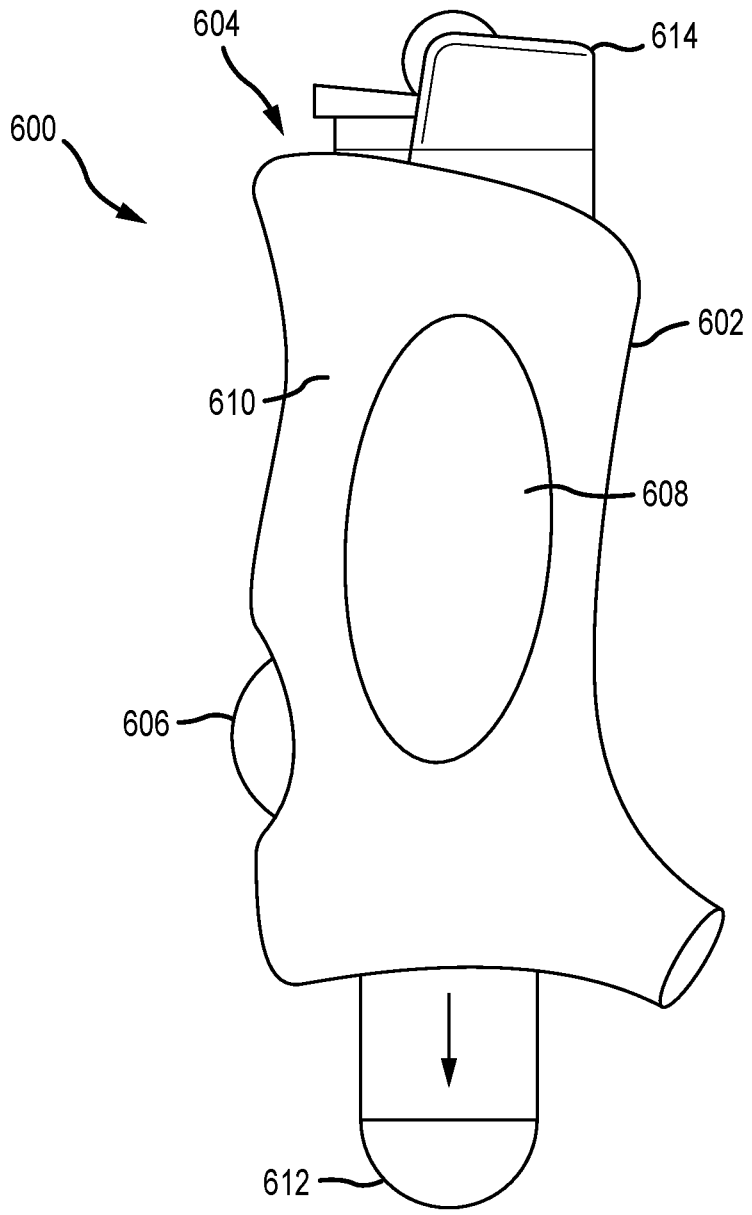
FIG. 16 is a left side elevation view of a lighter holder having a carb cap according to embodiments of the invention.

FIG. 16 depicts a pipe tool 600 that may be similar to the other pipe tools described herein. For example, pipe tool 600 may include a sheath 602 that includes a central recess 604 for receiving a lighter 614. The sheath 602 may define a slot (similar to slot 9) and/or an additional recess (similar to additional recess 214) that extends along at least a portion of the length of the sheath 602 and that is spaced apart from the central recess 604. The slot and/or additional recess may be configured to receive and retain at least a portion of an elongated poker 606, which may be similar to poker 8 and/or elongated poker 216 described above. The pipe tool 600 may also include a tamper portion. For example, the elongated poker 606 may include a tamper portion similar to second end 220 described in relation to FIG. 12. In other embodiments, the tamper portion may be formed into the sheath 602, similar to protrusion 6 described in relation to FIGS. 1-11.

In some embodiments, the pipe tool 600 may include a carb cap or pipe bowl cover, which may be used to cover an opening of a pipe bowl to help retain heat within the pipe bowl. There are several ways in which the carb cap may be implemented into pipe tool 600. For example, in some embodiments, a carb cap 608 may be formed into a sidewall 610 of the sheath 602. For example, the carb cap 608 may be molded into the sheath 602 and/or a separate carb cap 608 body may be affixed to the sheath 602 using an adhesive, magnet, and/or mechanical fastener. In such embodiments, the pipe tool 600 itself may be positioned over the pipe bowl, with the portion of the sheath 602 forming the carb cap 608 being positioned directly over and in contact with edges of the pipe bowl.

In other embodiments, a carb cap may be extendable and/or removable from the sheath 602. For example, in some embodiments, a carb cap 612 may be removably coupled with the sheath 602, such as by using a snap fit and/or other disengageable connection. As illustrated here, the carb cap 612 is configured to be removably coupled with a bottom of the sheath 602, although in some embodiments the carb cap 612 may be coupled with a sidewall of the sheath 602. In some embodiments, rather than being fully removable, the carb cap may be configured to extend outward beyond an outer periphery of the sheath 602 such that a user may hold the sheath 602 to position the protruding carb cap over a pipe bowl. In yet other embodiments, a carb cap may be formed on an end of the elongated poker 606. For example, a second of the elongated poker 606 (similar to second end 220) may be shaped to act as a carb cap when the elongated poker 606 is removed from an additional recess formed in the sheath.

Figure 17:
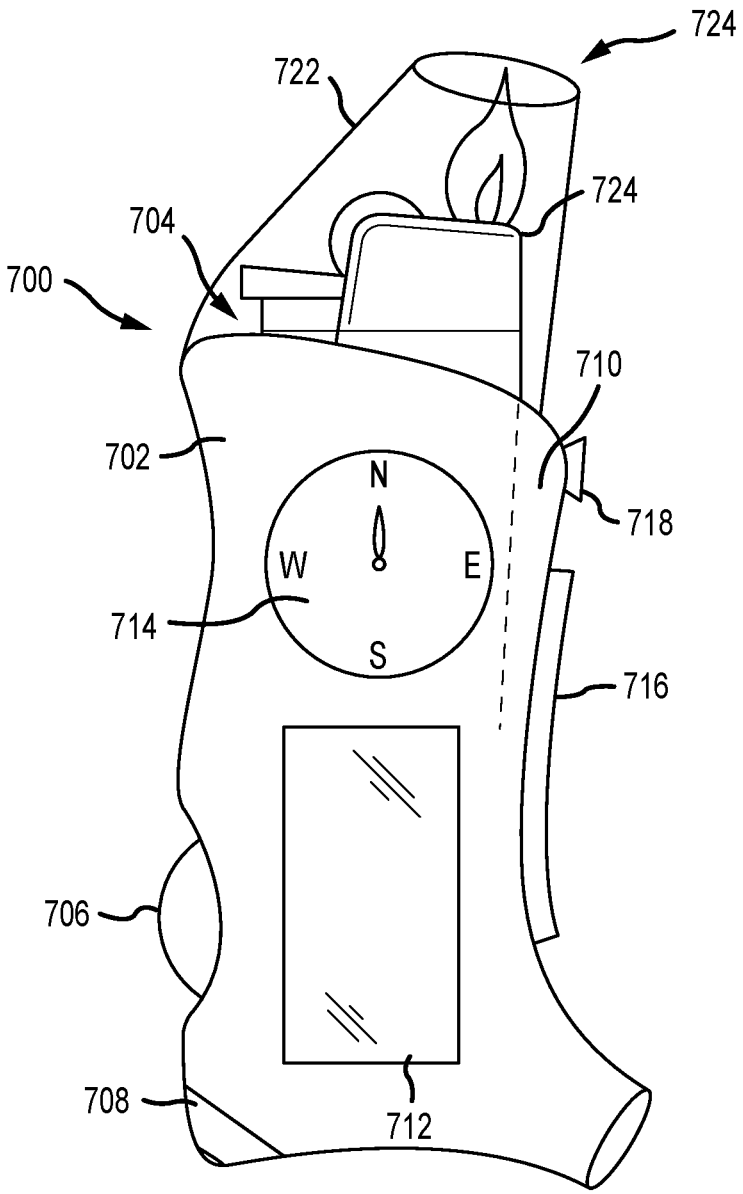
FIG. 17 is a left side elevation view of a lighter holder having outdoor accessories according to embodiments of the invention.

FIG. 17 depicts a pipe tool 700 that may be similar to the other pipe tools described herein. For example, pipe tool 700 may include a sheath 702 that includes a central recess 704 for receiving a lighter 724. In some embodiments, the sheath 702 may be formed from a material that is sufficiently buoyant such that the entire pipe tool 700 floats, even when holding a lighter and/or any materials stored within a compartment formed within the pipe tool 700. The sheath 702 may define a slot (similar to slot 9) and/or an additional recess (similar to additional recess 214) that extends along at least a portion of the length of the sheath 702 and that is spaced apart from the central recess 704. The slot and/or additional recess may be configured to receive and retain at least a portion of an elongated poker 706, which may be similar to poker 8 and/or elongate poker 216 described above. The pipe tool 700 may also include a tamper portion. For example, the elongated poker 706 may include a tamper portion similar to second end 220 described in relation to FIG. 12. In other embodiments, the tamper portion may be formed into the sheath 702, similar to protrusion 6 described in relation to FIGS. 1-11.

In some embodiments, the sheath 702 may define a whistle 708. The whistle 708 may be formed along at least one edge of the sheath 702 such a user may easily place their lips over the whistle 708 to produce a noise. As illustrated here, the whistle is formed in a corner of the sheath 702, however other locations are possible. The sheath 702 may further define one or more compartments 710. Compartment 710 may be similar to the compartment 308 described above, and may have an interior that is usable to store any number of objects. A cover (not shown) such as a door and/or drawer front may be included that allows the compartment to be covered and/or sealed when in a closed position. While shown with compartment 710 being formed along a minor face of the sheath 702, is will be appreciated that other locations may be used for the compartment 710.

In some embodiments, a mirror 712 may be affixed to the sheath 702, such as by using an adhesive and/or mechanical connection. Similarly, a navigation compass 714 may also be included affixed to the sheath 702. While both the mirror 712 and the compass 714 are illustrated as being secured to the same major surface of the sheath 702, in some embodiments one or both of the mirror 712 and the compass 714 may be positioned on a different surface of the sheath 702. Additionally, it will be appreciated that in some embodiments, the pipe tool 702 may only include one of the mirror 712 or the compass 714. In some embodiments, a flint striker 716 is affixed on an exterior surface of the sheath 702. For example, the flint striker 716 may be secured to an edge and/or face of the sheath 702 and allows a user to generate sparks to start a fire.

In some embodiments, the pipe tool 700 may include a flashlight 718 that is embedded and/or otherwise secured to the sheath 702. For example, the flashlight 718 may include a light element (such as a light emitting diode (LED), a power element (such as a battery), and an actuator (such as a button) that allows a user to selectively activate the flashlight 718. The flashlight 718 may be positioned at any location on the sheath 702. In some embodiments, the flashlight 718 may have simple on/off functions, while in other embodiments, by manipulating the actuator multiple times and/or in different ways various functions of the flashlight 718 may be activated. For example, different functions of the flashlight 718 may include color changes of the emitted light, an intensity adjustments of the emitted light, whether the light is a steady beam or flashing, a frequency of flashes, and/or other functions.

In some embodiments, the pipe tool 700 may include a wind cover 720. The wind cover 720 may be pivotally attached to the sheath 702 and/or may be fully removable from the sheath 702 and may be retained in an engaged position using a snap fit connection, magnets, and/or other mechanical connector. The wind cover 720 may be configured to be disposed over the central recess 704 such that the wind cover extends over a top of a lighter secured within the central recess 704. For example, the wind cover 720 may be generally cone-shaped such that the wind cover 720 tapers toward a position where a tip of a flame from the lighter is located. A tip of the wind cover 720 may define an opening 722 that provides access to the tip of the flame. Such a wind cover 720 protects the light flame from lateral wind. The wind cover 720 may be configured to provide access to a spark wheel and/or other lighting mechanism of the lighter such that the lighter may be activated while the wind cover 720 is engaged. In some embodiments, one or more small apertures may be formed in a side of the wind cover 720 to provide some additional oxygen to reach the flame while still blocking a majority of any wind. In some embodiments, rather than having opening 722 formed in a top of the wind cover 720, the opening may be formed in a lateral side of the wind cover. Such a design allows the lighter to be held horizontally to light an object.

In some embodiments, the pipe tool 700 may include removable and/or pivotable tools as described above in relation to pipe tools 400 and 500. In some embodiments, the tools may be the same or similar to those described elsewhere herein, while in other embodiments the tools may be directed to personal care. For example, the tools may include one or more types of makeup brushes, tweezers, a comb, other makeup applicators, eyebrow stencils, makeup removal tools, and the like. It will be appreciated that the above list is not exhaustive and that other self-care tools, makeup devices, and the like may be incorporated into pipe tool 700.

Figure 18:
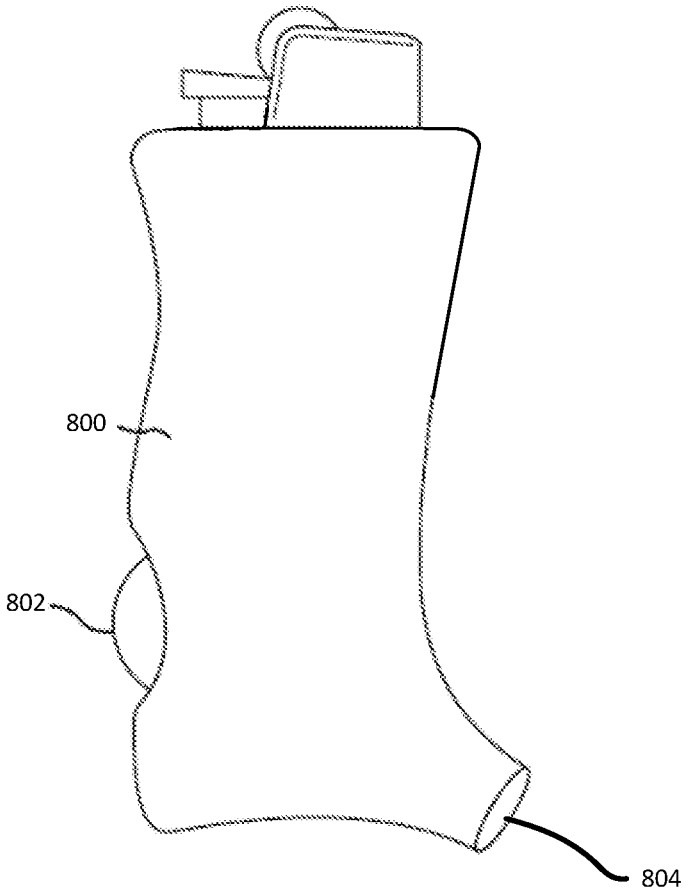
FIG. 18 is a left side elevation view of a lighter according to embodiments of the invention.

In some embodiments, rather than providing a sheath or holder for a disposable and/or reusable lighter, a lighter may have a built-in housing or casing that contains any number of tools. For example, FIG. 18 illustrates one embodiment of a lighter 800 having a casing that includes one or more tools. Lighter 800 may be a disposable lighter that may be thrown away, recycled, and/or otherwise discarded after all of the lighter fluid has been utilized. In other embodiments, the lighter 800 may be refillable such that the lighter 800 may be used indefinitely by adding new lighter fluid and/or replacing flints and/or other ignition mechanisms. In such embodiments, the casing of the lighter 800 may define one or more sealable fluid ports that allow a lumen and/or other lighter fluid refill device to be interfaced with a fuel reservoir of the lighter 800 for refueling purposes.

In some embodiments, the housing of lighter 800 may define a slot (similar to slot 9) and/or an additional recess (similar to additional recess 214) that extends along at least a portion of the length of the housing of the lighter 800. The slot and/or additional recess may be configured to receive and retain at least a portion of an elongated poker 802, which may be similar to poker 8 and/or elongate poker 216 described above. The elongated poker 802 may be movable between a stowed position and an open position. In the stowed position, at least a portion of the elongated poker is disposed within the slot or the additional recess. For example, the stowed position may involve the elongated poker 802 being pivoted into the slot as described in relation to FIG. 1 or may involve the elongated poker 802 being slidingly received within the additional recess as described in relation to FIG. 12. In the open position at least a portion of the elongated poker 802 is at least partially disengageable from the slot or the additional recess such that a tip of the elongated poker 802 is insertable into a pipe bowl. For example, the open position may involve the elongated poker 802 being pivoted out of the slot such that a tip of the elongated poker 802 extends away from housing of the lighter 800 and is insertable into a pipe bowl as illustrated in relation to FIGS. 1-11. In other embodiments, the open position may involve the elongated poker 802 being partially and/or fully slid out of and/or otherwise removed from the additional recess.

The lighter 800 may also include a tamper portion 804. For example, the elongated poker 802 may include a tamper portion similar to second end 220 described in relation to FIG. 12. In other embodiments, such as illustrated here, a tamper portion 804 may be formed into the housing of lighter 800, similar to protrusion 6 described in relation to FIGS. 1-11.

Lighter 800 may also include one or more additional tools or features, such as those described in FIGS. 12-17. For example, the housing of lighter 800 may further define at least one storage compartment similar to those described in relation to FIG. 13. A keyring and/or other attachment mechanism may also be included and/or formed into the housing of lighter 800. In some embodiments, one or more tools may be permanently and/or removably attached to the housing of lighter 800. For example, in some embodiments a magnet may be affixed to at least one sidewall of the housing of lighter 800 that allows various tools to be magnetically attached to the housing of lighter 800 and/or allows the lighter 800 (including any attached tools, accessories other stored items, and/or lighter) to be magnetically secured to a ferromagnetic structure as described in relation to FIG. 14. In other embodiments, a number of tools may be secured to the lighter 800 in a manner similar to that described in relation to the sheath of FIG. 15. In some embodiments, lighter 800 may include a carb cap such as described in relation to FIG. 16. In other embodiments, features of FIG. 17 may be incorporated into the lighter 800. For example, the housing of the lighter 800 may be formed from a material that is sufficiently buoyant such that the entire lighter 800 floats. In some embodiments, the housing of the lighter 800 may define a whistle. In some embodiments, a mirror, flint striker, and/or navigation compass may be affixed to the exterior of the housing of the lighter 800, such as by using an adhesive and/or mechanical connection. In some embodiments, the lighter may include a flashlight that is embedded and/or otherwise secured to the housing of the lighter 800. In some embodiments, the lighter 800 may include a wind cover and/or additionally removable and/or fixed tools.

It will be appreciated that the pipe tools and lighters described herein may include some or all of the features described in relation to the various embodiments described herein. Any combination of the features described herein may be utilized in a particular embodiment to provide a pipe tool and/or lighter having the desired combination of features and capabilities.

It should be noted that the systems and devices discussed above are intended merely to be examples. It must be stressed that various embodiments may omit, substitute, or add various procedures or components as appropriate. Also, features described with respect to certain embodiments may be combined in various other embodiments. Different aspects and elements of the embodiments may be combined in a similar manner. Also, it should be emphasized that technology evolves and, thus, many of the elements are examples and should not be interpreted to limit the scope of the invention.

Specific details are given in the description to provide a thorough understanding of the embodiments. However, it will be understood by one of ordinary skill in the art that the embodiments may be practiced without these specific details. For example, well-known structures and techniques have been shown without unnecessary detail in order to avoid obscuring the embodiments. This description provides example embodiments only, and is not intended to limit the scope, applicability, or configuration of the invention. Rather, the preceding description of the embodiments will provide those skilled in the art with an enabling description for implementing embodiments of the invention. Various changes may be made in the function and arrangement of elements without departing from the spirit and scope of the invention.

Having described several embodiments, it will be recognized by those of skill in the art that various modifications, alternative constructions, and equivalents may be used without departing from the spirit of the invention. For example, the above elements may merely be a component of a larger system, wherein other rules may take precedence over or otherwise modify the application of the invention. Also, a number of steps may be undertaken before, during, or after the above elements are considered. Accordingly, the above description should not be taken as limiting the scope of the invention.

Also, the words "comprise", "comprising", "contains", "containing", "include", "including", and "includes", when used in this specification and in the following claims, are intended to specify the presence of stated features, integers, components, or steps, but they do not preclude the presence or addition of one or more other features, integers, components, steps, acts, or groups.

Unless defined otherwise, all technical and scientific terms used herein have the same meaning as commonly or conventionally understood. As used herein, the articles "a" and "an" refer to one or to more than one (i.e., to at least one) of the grammatical object of the article. By way of example, "an element" means one element or more than one element. "About" and/or "approximately" as used herein when referring to a measurable value such as an amount, a temporal duration, and the like, encompasses variations of ±20% or ±10%, ±5%, or +0.1% from the specified value, as such variations are appropriate to in the context of the systems, devices, circuits, methods, and other implementations described herein. "Substantially" as used herein when referring to a measurable value such as an amount, a temporal duration, a physical attribute (such as frequency), and the like, also encompasses variations of ±20% or ±10%, ±5%, or +0.1% from the specified value, as such variations are appropriate to in the context of the systems, devices, circuits, methods, and other implementations described herein.

As used herein, including in the claims, "and" as used in a list of items prefaced by "at least one of" or "one or more of" indicates that any combination of the listed items may be used. For example, a list of "at least one of A, B, and C" includes any of the combinations A or B or C or AB or AC or BC and/or ABC (i.e., A and B and C). Furthermore, to the extent more than one occurrence or use of the items A, B, or C is possible, multiple uses of A, B, and/or C may form part of the contemplated combinations. For example, a list of "at least one of A, B, and C" may also include AA, AAB, AAA, BB, etc.

What is claimed is:

1. A smoker's pipe tool, comprising:

a sheath having a top, a bottom, and at least one sidewall extending between the top and the bottom along a longitudinal axis of the sheath, the sheath defining a central recess that extends along at least a portion of the longitudinal axis and that is configured to slidingly receive a lighter, wherein the sheath defines an additional recess that extends alongside at least a portion of the central recess;

an elongated poker that is removably coupled with the sheath, the elongated poker having a first end and a second end; and a wind cover that is configured to extend over at least a portion of the central recess when the lighter is received therein, the wind cover defining an opening that is positioned to provide access to a flame generated by the lighter, wherein:

the wind cover tapers inward from a base of the wind cover to a top end of the wind cover;

the wind cover is pivotable relative to the sheath to selectively provide access to the central recess;

the second end is thicker than the first end and is configured to function as a pipe bowl tamper; and the additional recess is configured to retain the elongated poker when the elongated poker is slidingly received within the additional recess.

2. The smoker's pipe tool of claim 1, wherein:

the bottom of the sheath further defines a bottle opener.

3. The smoker's pipe tool of claim 1, wherein:

the elongated poker comprises a step that transitions a thickness of the first end to a thickness of the second end.

4. The smoker's pipe tool of claim 1, wherein:

the at least one sidewall of the sheath further defines a cutout that extends through the at least one sidewall and provides access to a portion of the central recess.

5. The smoker's pipe tool of claim 1, wherein:
the sheath further defines a closeable compartment that is spaced apart from the central recess and the additional recess.

6. The smoker's pipe tool of claim 5, wherein:
the sheath further comprises a hinged cover that is moveable between an open position and a closed position;
when in the closed position the hinged cover extends over an opening of the closeable compartment; and
when in the open position the hinged cover provides access to an interior of the closeable compartment.

7. The smoker's pipe tool of claim 5, wherein:
the closeable compartment comprises a sealing mechanism such that the closeable compartment is waterproof when in a closed position.

8. A smoker's pipe tool, comprising:
a sheath having a top, a bottom, and at least one sidewall extending between the top and the bottom along a longitudinal axis of the sheath, the sheath defining a central recess that extends along the longitudinal axis and that is configured to slidingly receiving a lighter, wherein:
the sheath defines a slot or an additional recess that extends along at least a portion of the length of the sheath; and
the sheath defines a closeable compartment that is spaced apart from the central recess and the slot or the additional recess;
an elongated poker that is coupled with the sheath and is movable between a stowed position and an open position;
at least one pivoting connector having a proximal end that is coupled with the sheath, the at least one pivoting connector comprising a distal end that comprises a first connection mechanism that is pivotable relative to the sheath to a position in which the first connection mechanism extends outward from the sheath; and
at least one tool comprising a second connection mechanism that is pivotally coupled with the sheath using the first connection mechanism, the first connection mechanism being detachably coupled with the second connection mechanism, wherein:
when the elongated poker is in the stowed position, at least a portion of the elongated poker is disposed within the slot or the additional recess;
when the elongated poker is in the open position at least a portion of the elongated poker is at least partially disengageable from the slot or the additional recess such that a tip of the elongated poker is insertable into a pipe bowl; and
one or both of the sheath or the elongated poker comprises a pipe bowl tamper portion.

9. The smoker's pipe tool of claim 8, wherein:
the sheath is formed from a material that is sufficiently buoyant to float when a lighter is secured within the central recess.

10. The smoker's pipe tool of claim 8, wherein:
the sheath further defines a whistle.

11. The smoker's pipe tool of claim 8, further comprising:
a flashlight coupled with the sheath, the flashlight comprising a light source, a power source, and an activation mechanism.

12. The smoker's pipe tool of claim 8, further comprising:
a mirror that is coupled with an exterior surface of the sheath.

13. The smoker's pipe tool of claim 8, further comprising:
a flint striker that is coupled with an exterior surface of the sheath.

14. The smoker's pipe tool of claim 8, further comprising:
a navigation compass coupled with an exterior surface of the sheath.

15. A smoker's pipe tool, comprising:
a sheath having a top, a bottom, and at least one sidewall extending between the top and the bottom along a longitudinal axis of the sheath, the sheath defining a central recess that extends along the longitudinal axis and that is configured to slidingly receiving a lighter, wherein the sheath defines a slot or an additional recess that extends along at least a portion of the length of the sheath;
a carb cap that is moveably coupled with the at least one sidewall of the sheath, wherein:
the carb cap is movable relative to the at least sidewall of the sheath to an extended position in which the carb cap extends outward beyond an outer periphery of the sheath;
the carb cap being configured to cover an opening of a pipe when in the extended position; and
an elongated poker that is coupled with the sheath and is movable between a stowed position and an open position, wherein:
when the elongated poker is in the stowed position, at least a portion of the elongated poker is disposed within the slot or the additional recess;
when the elongated poker is in the open position at least a portion of the elongated poker is at least partially disengageable from the slot or the additional recess such that a tip of the elongated poker is insertable into a pipe bowl; and
one or both of the sheath or the elongated poker comprises a pipe bowl tamper portion.

16. The smoker's pipe tool of claim 15, further comprising:
a magnetic element that is coupled with an exterior surface of the sheath; and
at least one tool that is configured to be secured to the sheath using the magnetic element.

17. The smoker's pipe tool of claim 15, further comprising:
a wind cover that is configured to extend over at least a portion of the central recess when the lighter is received therein.

18. The smoker's pipe tool of claim 15, further comprising:
at least one connector that is coupled with the sheath; and
at least one tool that is configured to be removably secured to the sheath using the at least one connector.

19. The smoker's pipe tool of claim 1, wherein:
the wind cover is configured to provide access to a lighting mechanism of the lighter such that the lighter may be activated while the wind cover is positioned over the portion of the central recess.

20. The smoker's pipe tool of claim 1, wherein:
the wind cover defines at least one aperture on a lateral side of the wind cover.

21. A smoker's pipe tool, comprising:
a sheath having a top, a bottom, and at least one sidewall extending between the top and the bottom along a longitudinal axis of the sheath, the sheath defining a central recess that extends along at least a portion of the longitudinal axis and that is configured to slidingly receive a lighter; and a wind cover that is configured to extend over at least a portion of the central recess when the lighter is received therein, the wind cover defining an opening that is positioned to provide access to a flame generated by the lighter; wherein:

the wind cover tapers inward from a base of the wind cover to a top end of the wind cover; and the wind cover is pivotable relative to the sheath to selectively provide access to the central recess.

* * * * *